US005279425A

United States Patent [19]

Botos

[11] Patent Number: 5,279,425

[45] Date of Patent: Jan. 18, 1994

[54] STACKABLE SCREEN MODULE ARRANGEMENT

[76] Inventor: Alex M. Botos, 5490 Vauclin, Brossard, Quebec, Canada, J4W 1P8

[21] Appl. No.: 893,507

[22] Filed: Jun. 4, 1992

[51] Int. Cl.[5] ..... B07B 1/28

[52] U.S. Cl. ..... 209/315; 209/319

[58] Field of Search ..... 209/315, 319, 320, 322, 209/363, 397, 326

[56] References Cited

U.S. PATENT DOCUMENTS

| | | | |
|---|---|---|---|
| 1,234,299 | 7/1917 | Dibert | 209/315 X |
| 2,191,923 | 2/1940 | Cecka | 209/315 |
| 2,285,348 | 6/1942 | Morgan | 209/315 |
| 3,285,413 | 11/1966 | Taylor-Smith | 209/315 |
| 3,341,012 | 9/1967 | Thacher | 209/315 |
| 4,107,035 | 8/1978 | Foresman | 209/315 X |
| 4,340,469 | 7/1982 | Archer | 209/315 |
| 4,632,751 | 12/1986 | Johnson et al. | 209/326 |
| 4,699,713 | 10/1987 | Tieben | 209/315 |
| 4,795,552 | 1/1989 | Yun et al. | 209/319 |

FOREIGN PATENT DOCUMENTS

| | | | |
|---|---|---|---|
| 0642844 | 9/1950 | United Kingdom | 209/315 |

*Primary Examiner*—Joseph E. Valenza
*Assistant Examiner*—Tuan Nguyen
*Attorney, Agent, or Firm*—Fishman, Dionne & Cantor

[57] ABSTRACT

Each stackable screen module arrangement includes a first elongated side wall and a second elongated side wall, the side walls being spaced from each other by a plurality of cross members which extend between the side walls. The cross members also serve to support a screen. Connecting plates connect a lower one of the arrangements to an upper one of the arrangements when the arrangements are stacked to form an assembly. Each plate is connected to the top edge of a side wall of a lower arrangement and the bottom edge of a side wall of an adjacent upper arrangement. Aligned cut-outs are provided in the side walls of the lowermost arrangement and aligned cut-outs are also provided in the side walls of the second lowermost arrangement, and the two sets of cut-outs are aligned with each other to receive, support and surround the vibrator.

9 Claims, 6 Drawing Sheets

HALF SECTION A-A

STACKABLE SCREEN MODULE ARRANGEMENT

BACKGROUND OF INVENTION

1. Field of the Invention

The invention relates to a stackable screen module arrangement for use in a stacked vibratory screen assembly. The invention also relates to such a stacked vibratory screen assembly.

2. Description of Prior Art

Known in the prior art are vibratory screens for, for example screening material such as gravel, crushed rock and the like. Examples of such vibratory screens are illustrated in, for example, U.S. Pat. No. 3,285,413, Taylor-Smith, Nov. 15, 1966, U.S. Pat. No. 3,341,012, Thacher, Sep. 12, 1967 and U.S. Pat. No. 4,340,469, Archer, Jul. 20, 1982.

The '413 patent teaches a stacked screen arrangement including overlapping screens 35 and 36. As can be seen, the '413 patent does not teach a module such arrangement.

The '012 patent teaches an arrangement including a plurality of stacked screens 190 having side walls 198. (See FIG. 2). The adjacent screens are rods 201 and 203 fastened at their lower ends 206 and 208 to opposite sides of a base plate 125 of the screen unit 15, as is illustrated in FIG. 2 of the '012 patent. Although the screens and side walls 198 could be seen as forming modules, the hold down and clamping means is a relatively awkward arrangement, and there is no real explanation in the '012 patent about how the spacers between side walls 198 are held in place.

The '469 patent also teaches a stacked screen arrangement. As seen in FIG. 1 of the patent, screens 22, 23 and 24 are stacked in a vertical direction and held in frame 15 which includes side walls 16 and 17. As can be seen, each side plate 16 and 17 is a one-piece construction. Such large side plates are difficult to handle, and separate type plates must be provided for horizontal versus inclined screen arrangements. There is no teaching in the '469 patent relating to the possibility of modular constructions.

In addition, with the '413 and '469 patents, as the vibrators have to be formed on the site, they cannot be pre-assembled, nor can the vibrators be shipped as units.

Further difficulties with the '413 and '469 arrangements are that the vibrators have to be formed on the site as they are formed within the assembled frames. As there is a good deal of dust and sand on the sites, the vibrators can be contaminated during the formation thereof. Additionally, the sites are not the most convenient places for assembling the vibrators.

SUMMARY OF INVENTION

It is therefore an object of the invention to provide a stackable screen module arrangement and a vibratory screen assembly which is formed using a plurality of such stackable screen module arrangements.

It is a further object of the invention to provide such an arrangement which permits the vibrator to be formed off-site and to be merely dropped into place while the stacked screen assembly is being assembled.

In accordance with a particular embodiment of the invention there is provided a stacked vibratory screen assembly comprising a plurality of stackable screen module arrangements, wherein each said stackable screen module arrangement comprises:

a screen having a first side edge and a second, spaced, parallel side edge, said first and second side edges extending in a longitudinal direction of said screen;

a first elongated side wall and a second elongated side wall, each said first and second elongated side walls having a top portion and a bottom portion;

said first elongated side wall extending along said first side edge and said second elongated side wall extending along said second side edge;

means for connecting adjacent stackable screen module arrangements to each other;

said assembly further including a vibrating means;

said assembly including a lowermost stackable screen module arrangement, the first and second side walls of said lowermost arrangement having a top edge and a bottom edge;

a cut-out in each said first and second side walls extending downwardly from the top edges of each said side plate;

a cut-out in said first side wall being in alignment with the cut-out in said second side wall;

whereby, said vibrator means is received in and supported by the edges of said aligned cut-outs.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
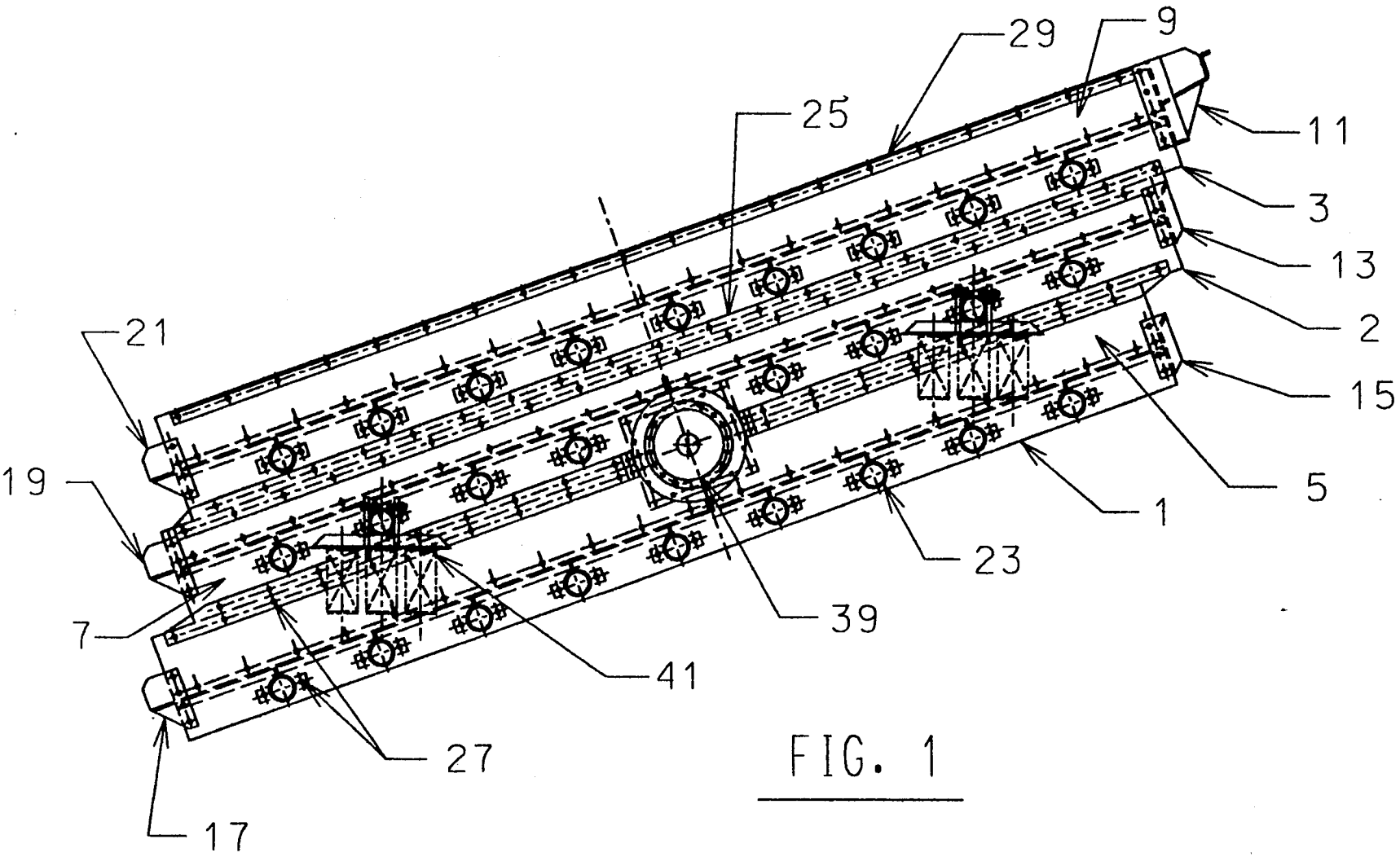
FIG. 1 is a side view of an inclined assembled vibratory screen arrangement in accordance with the invention.
Figure 2:
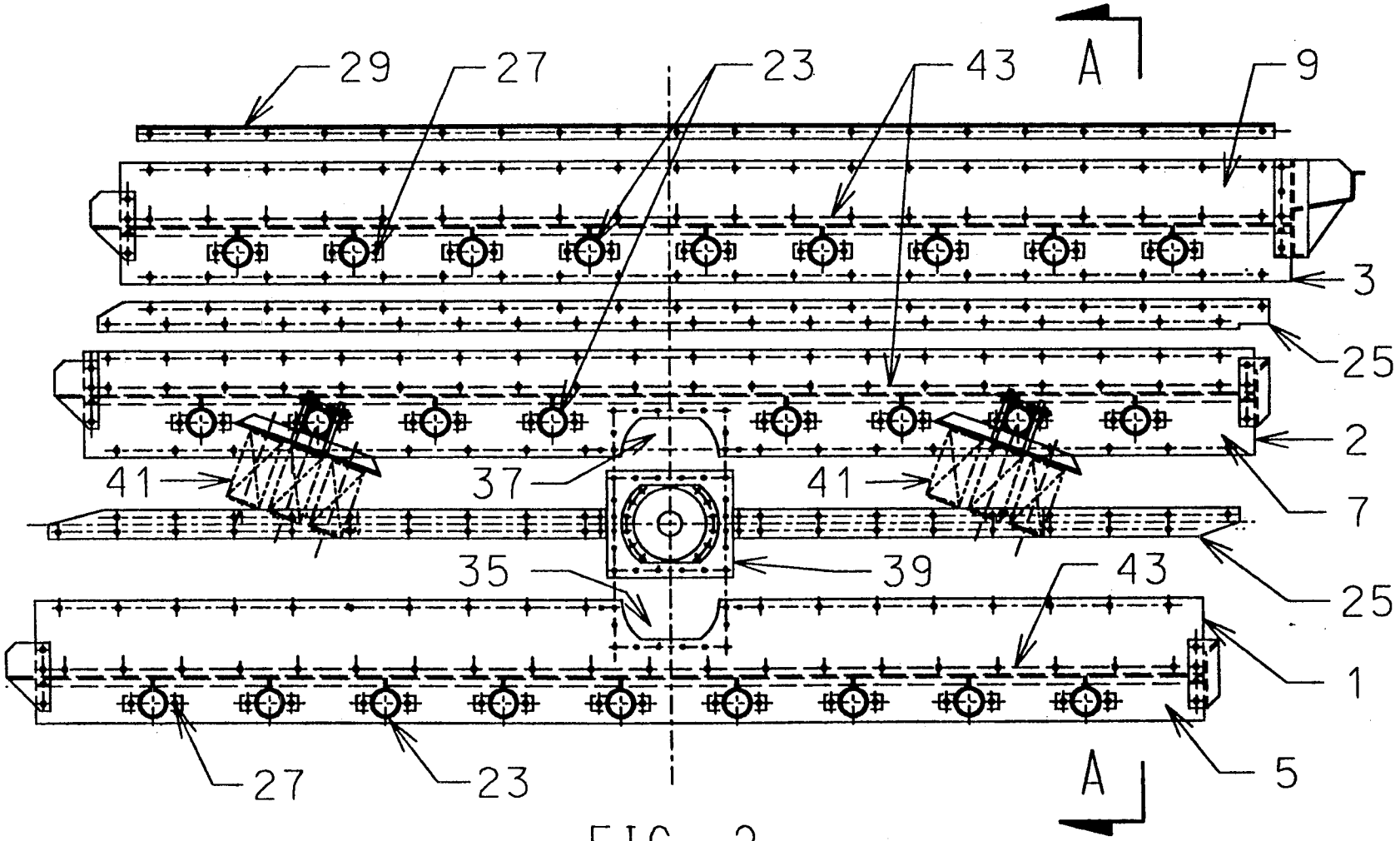
FIG. 2 is an exploded view of FIG. 1.
Figure 3:
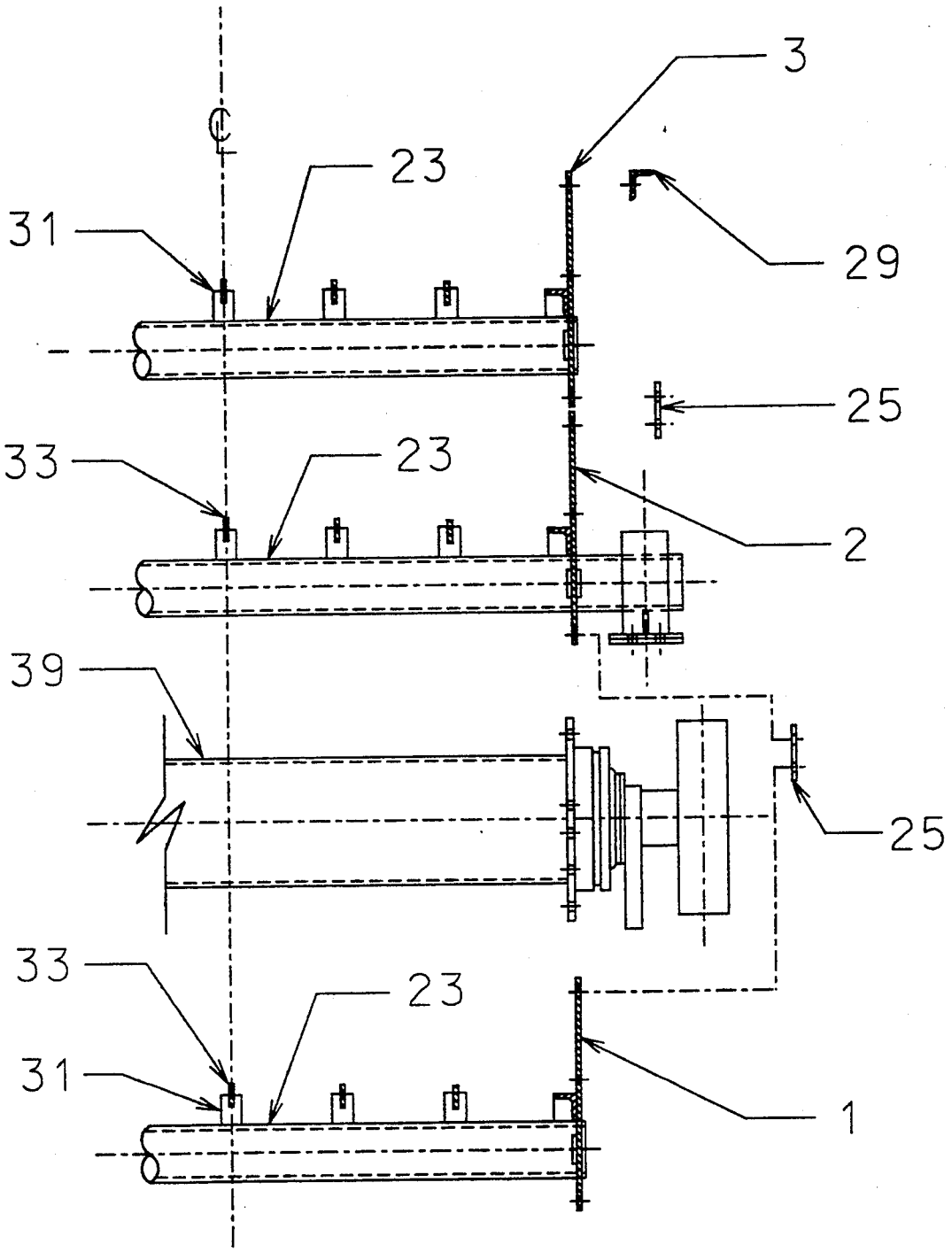
FIG. 3 is a half-section through A—A of FIG. 2.

Referring to FIGS. 1, 2 and 3, there is illustrated a stacked vibratory screen assembly consisting of three stackable screen module arrangements 1, 2 and 3. The stackable arrangements comprise side walls 5, 7 and 9 respectively. The top arrangement 3 includes a feed box 11, and the lowermost arrangement 1 and the second lowermost arrangement 2 include back plates 13 and 15. Each arrangement 1, 2 and 3 includes, at the front ends thereof, discharge lips 17, 19 and 21.

A plurality of cross-members 23 extend between adjacent ones of the side walls. The cross-members 23 serve both to support a screen, as will be discussed below, and to space adjacent ones of the side walls from each other.

Figure 4:
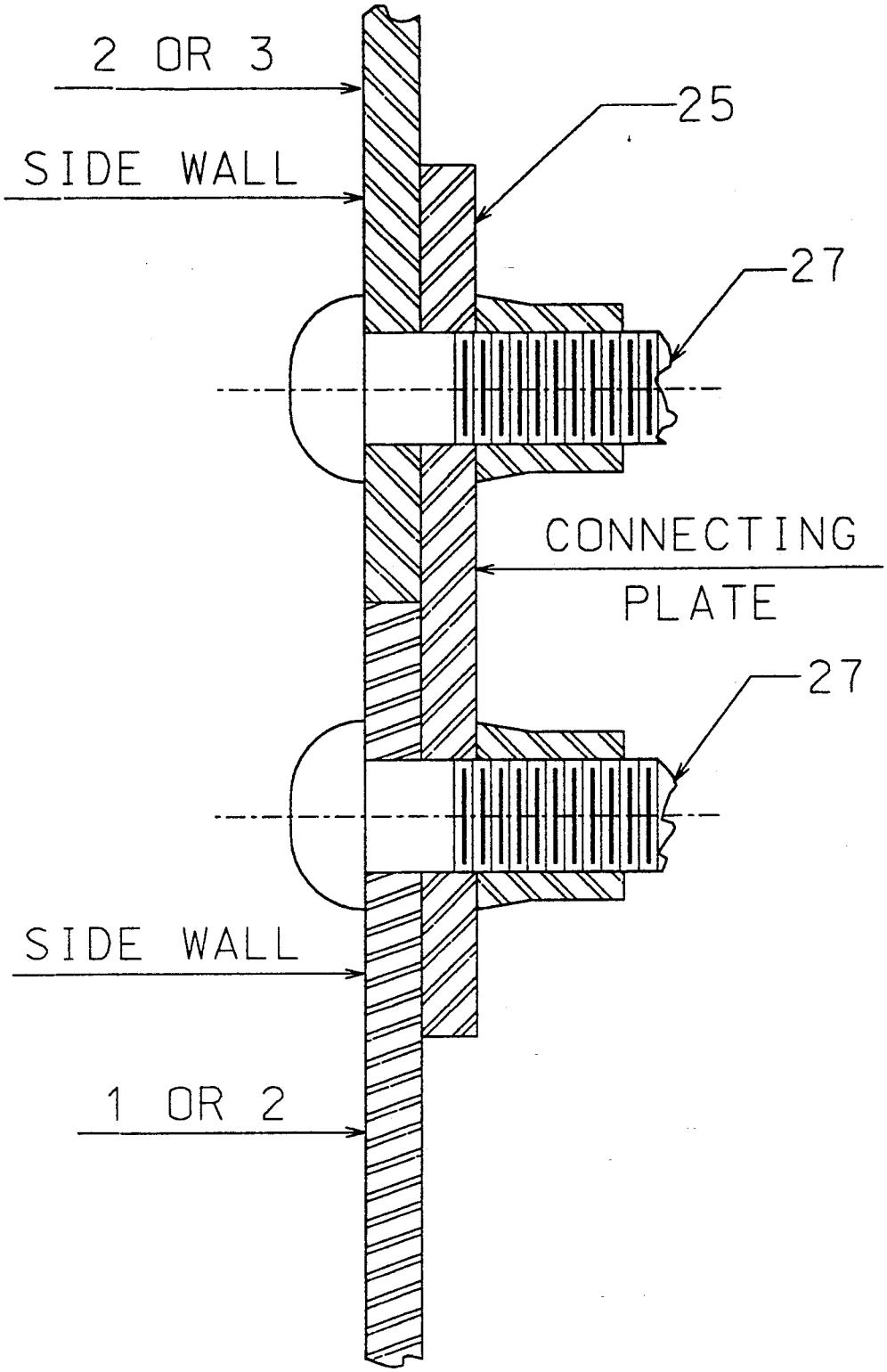
FIG. 4 illustrates how the cross-member connects two adjacent modules.

Connecting plates 25 are provided to connect the stacked side walls, and therefore the stacked arrangements, to each other. As seen in FIG. 4, the connecting plate 25 connects the top part of a lower side wall (1) to the bottom part of an upper side wall (3) using huckbolt fasteners 27.

The top of the uppermost side wall 3 includes a side wall angle 29.

As best seen in FIG. 1, the connecting plates 25 and the side wall angle 29 extend along respective edges of their respective side walls for substantially the full length thereof.

Figure 5A:
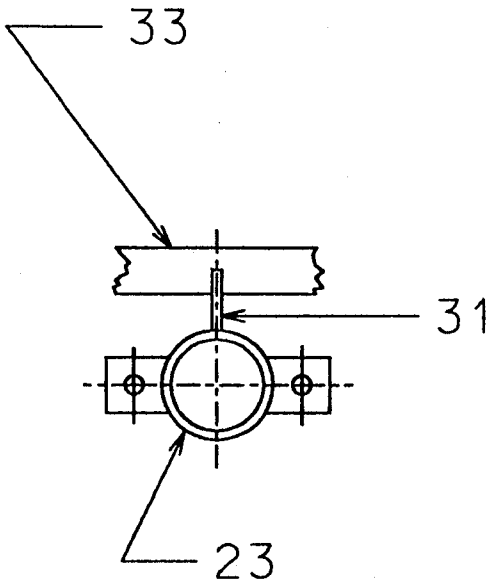
FIGS. 5A and 5B illustrate in greater detail the cross-member.
Figure 5B:
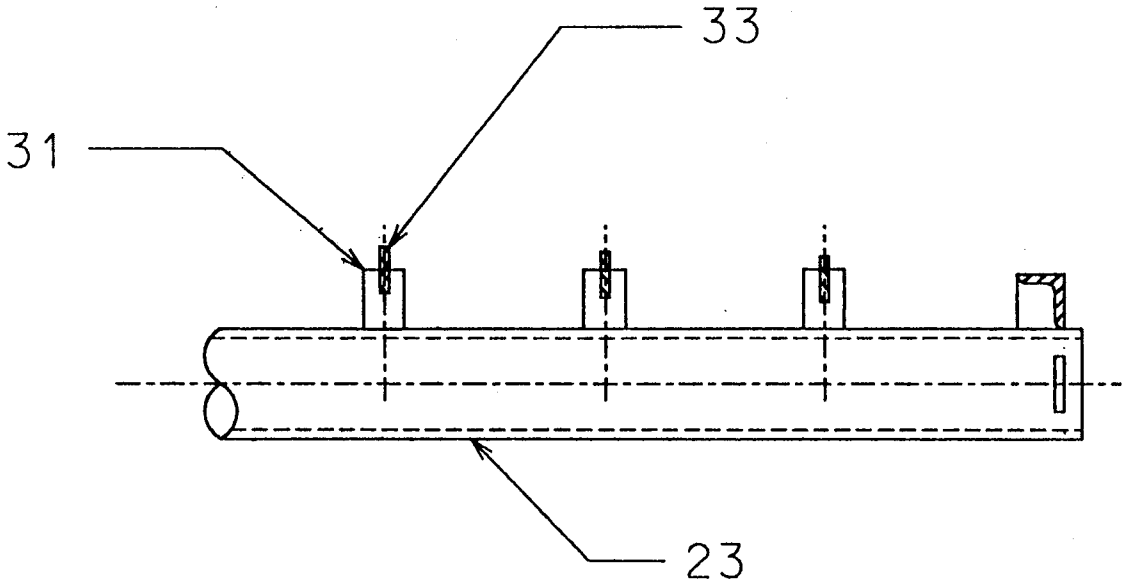

As seen in FIGS. 5A and 5B, mounted along the top surface of the cross members 23 are a plurality of equally spaced support brackets 31 all being of equal height. Inserts 33 are mounted in the support brackets, and a screen is supported at the top surface of the inserts.

Turning now to FIG. 2, it can be seen that the side wall 5 of the lowermost arrangement 1 includes a cut-out 35 which extends downwardly from the upper edge of the side plate 5. It will be understood that both side wall of the lowermost unit will have equal sized cut-outs 35, and that the cut-outs 35 in the side walls 5 are in alignment.

It will also be seen in FIG. 2 that the side walls 7 of the second lowermost arrangement 2 also includes cut-outs 37. Once again, the cut-outs 37 of the two side walls 7 are in alignment. In addition, the cut-outs 37 are in alignment with the cut-outs 35.

As can be seen in FIG. 1, the vibrator 39 is supported in the cut-outs 35 and 37 in the stacked vibratory screen assembly.

Spring means 41 are supported on both sides of the assembly by pre-selected ones of the cross members 23.

With the inventive arrangement, the side walls can be made in several different lengths for different uses and of the same shape. When an order is received, then the requisite number of side walls, cross members, feed boxes, back plates and discharge lips can be sent out as separate units in unassembled form and assembled at the site. This is, of course, quite more efficient and less costly than shipping a fully assembled vibratory screen.

In this regard, before the side walls are shipped out, the cut-outs 35 and 37 would be cut out of the appropriate side walls. At the site, the lowermost arrangement would be first assembled. The vibrator 39 would be dropped into the cut-outs 35 and supported by the edges of the lowermost arrangement. The second lowermost arrangement would then be assembled and stacked on top of the lowermost arrangement so that the cut-outs 37 are in alignment with the cut-outs 35 and overlie the vibrator 39. Connecting bar 25 would then be connected to the top edges of the side walls of the lowermost arrangement and the bottom edges of the side walls of the second lowermost arrangement whereby to connect the lowermost arrangement to the second lowermost arrangement.

The uppermost arrangement would then be assembled and stacked on top of the second lowermost arrangement, and the uppermost arrangement would then be connected to the second lowermost arrangement by connecting bars 25.

The spring means would then be mounted on selected ones of the cross members 23 on both sides of the assembly.

It can be seen that, with this type of an arrangement, the vibrator can be pre-assembled before shipping so that no assembly of the vibrator is necessary at the working site. On the other hand, the remainder of the vibratory screen assembly can be disassembled and shipped in its disassembled state.

Although not above-mentioned, it will be clear that the screens 43 (see FIG. 2) would be mounted in each arrangement before the next level of arrangement is stacked on top of a lower arrangement.

When the remainder of the parts have been assembled, the side walls 29 are connected to the top edges of the side walls of the uppermost arrangement.

Figure 6:
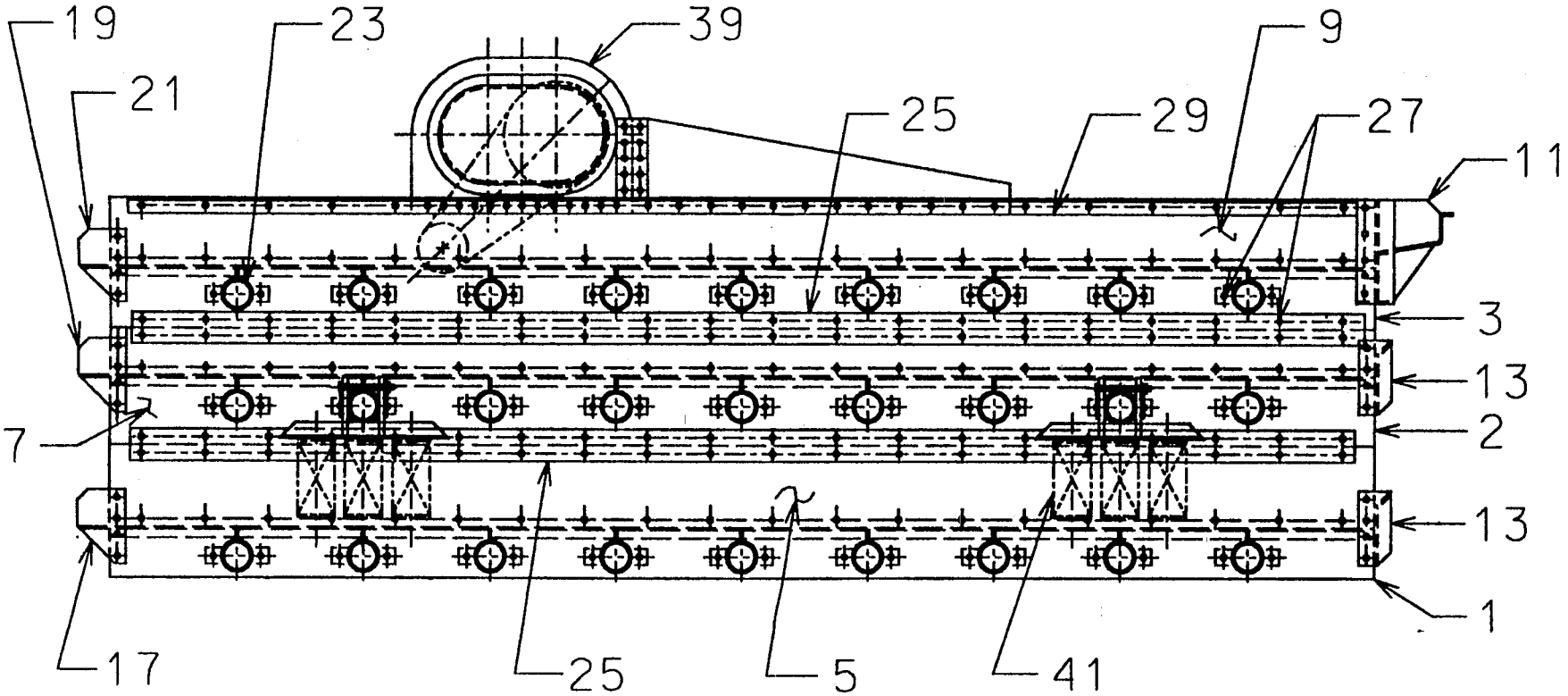
FIG. 6 is a side view of a horizontal assembled vibratory screen arrangement in accordance with the invention.

FIGS. 1 to 5 illustrate an inclined stacked vibratory screen assembly. FIG. 6 illustrates a horizontal such stacked vibratory screen assembly. Reference numerals in FIG. 6 illustrate the same parts as illustrated in FIGS. 1 to 5.

With a horizontal assembly, the vibrator 39 is mounted on top of the assembly as illustrated in FIG. 6. Accordingly, there is no need for cut-outs in arrangements 1 and 2 as in the FIGS. 1 to 5 embodiment. In all other respects, the assemblies are identical.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A stacked vibratory screen assembly comprising a plurality of stackable screen module arrangements, wherein each said stackable screen module arrangement comprises:

a screen having a first side edge and a second, spaced, parallel side edge, said first and second side edges extending in a longitudinal direction of said screen;

a first elongated side wall and a second elongated side wall, each said first and second elongated side walls having a top portion and a bottom portion;

said first elongated side wall extending along said first side edge and said second elongated side wall extending along said second side edge;

means for connecting adjacent stackable screen module arrangements to each other;

said assembly further including a vibrating means;

said assembly including a lowermost stackable screen module arrangement, the first and second side walls of said lowermost arrangement having a top edge and a bottom edge;

a cut-out in each said first and second side walls extending downwardly from the top edges of each said side plate;

the cut-out in said first side wall being in alignment with the cut-out in said second side wall;

whereby, said vibrator means is received in and supported by the edge of said aligned cut-outs.

2. An assembly as defined in claim 1 and including a second lowermost stackable screen module arrangement stacked on top of said lowermost stackable screen module arrangement, and wherein;

the first and second side walls of said second lowermost arrangement having a top edge and a bottom edge;

a cut-out in each said first and second side walls of said second lowermost arrangement extending upwardly from the bottom edges of each said side plates;

the cut-out in the first side wall of said second lowermost arrangement being in alignment with the cut-out of the second side wall of said second lowermost arrangement;

the cut-outs in the side walls of said second lowermost arrangement being in alignment with the cut-outs in respective side walls of the lowermost arrangement;

whereby, said vibrator means is surrounded by the edges of said cut-outs of said lowermost arrangement and said second lowermost arrangement.

3. An assembly as defined in claim 2 and including an uppermost stackable screen arrangement;

the first and second side walls of said uppermost arrangement having a top edge and a bottom edge;

a side plate angle mounted at the top edges of said first and second walls of said uppermost arrangement.

4. An assembly as defined in claim 3 having an input end and an output end;

a feed box connected at the input end of said first and second side walls of said uppermost arrangement.

5. An assembly as defined in claim 4 and including back plates mounted at the input ends of the first and second walls of said lowermost and said second lowermost arrangements.

6. An assembly as defined in claim 5 and including discharge lips at the output ends of all of said arrangements.

7. An arrangement as defined in claim 1 wherein said means for connecting comprises:

a plurality of cross-members extending between said side walls for supporting said screen and for spacing said first side wall from said second side wall;

first and second connecting plates for connecting a lower one of said arrangements with an upper one of said arrangements when said arrangements are stacked to form said assembly, said first connecting plate being connected to and extending along the top portion of a first side wall of a lower arrangement and the bottom portion of a first side wall of an adjacent upper arrangement, said second connecting plate being connected to the top portion of a second side wall of a lower arrangement and the bottom portion of a second side wall of an adjacent upper arrangement;

whereby to connect said upper arrangement to said lower arrangement to form said screen assembly.

8. An assembly as defined in claim 7 wherein each of said cross members includes a plurality of evenly spaced support brackets mounted thereon;

said support brackets supporting a screen.

9. An arrangement as defined in claim 8 and including spring means supported on the exterior side of preselected ones of said side walls by preselected ones of said cross members.

* * * * *